US008051502B2

(12) United States Patent
Chiang

(10) Patent No.: US 8,051,502 B2
(45) Date of Patent: Nov. 8, 2011

(54) SWIMMING GOGGLES

(76) Inventor: Herman Chiang, Chung-Ho (TW)

( * ) Notice: Subject to any disclaimer, the term of this patent is extended or adjusted under 35 U.S.C. 154(b) by 768 days.

(21) Appl. No.: 12/213,220

(22) Filed: Jun. 17, 2008

(65) Prior Publication Data

US 2009/0300828 A1 Dec. 10, 2009

(30) Foreign Application Priority Data

Jun. 5, 2008 (TW) ..... 97209937 U

(51) Int. Cl.
*A61F 9/02* (2006.01)

(52) U.S. Cl. ..... 2/448

(58) Field of Classification Search ..... 2/426, 428, 2/445, 448, 450
See application file for complete search history.

(56) References Cited

U.S. PATENT DOCUMENTS

| | | | | |
|---|---|---|---|---|
| 5,894,606 | A * | 4/1999 | Chiang | 2/440 |
| 6,253,387 | B1 * | 7/2001 | Yu | 2/428 |
| 6,289,523 | B1 * | 9/2001 | Chiang | 2/428 |
| 6,560,788 | B1 * | 5/2003 | Beltrani | 2/428 |
| 6,748,608 | B1 * | 6/2004 | Fukazawa | 2/440 |

* cited by examiner

*Primary Examiner* — Katherine Moran
(74) *Attorney, Agent, or Firm* — Cheng-Ju Chiang

(57) ABSTRACT

Swimming goggles are provided which include an integral left and right frames and nose bridge. The integral left and right frames and nose bridge include an outer frame and an inner frame. The outer frame includes front sections of the left and right frames, and a front section of the nose bridge. The inner frame includes rear sections of the left and right frames, and a rear section of the nose bridge. Lenses are received in the left and right frames of the outer frame and the inner frame. Pads are made of soft material and are assembled on the rear sections of the left and right frames. The outer frame and the inner frame are made of different material or of the same material with different rigidity.

7 Claims, 6 Drawing Sheets

SWIMMING GOGGLES

BACKGROUND OF THE INVENTION

1. Field of the Invention

The present invention relates to swimming goggles, and particularly to swimming goggles which have a left frame, a right frame, a nose bridge and pad that integrally formed by different material or of the same material with different rigidity.

2. Related Art

Swimming goggles are generally divided into two types: separate type and integral type. The separate type has a separate connecting member connecting a left frame and a right frame together; the integral type has a left frame and a right frame integrally formed with a connecting member. Lenses of the integral type have to be fixed on the left and the right frames. If the material is too soft, the left and right frames may be deformed by pulling force when being worn, and the lenses can not be fixed with retention. So the material is restrained in rigidity. Pads of the integral type are formed on the left and right frames and are not flexible relatively, therefore touching users' faces uncomfortably.

Moreover, the connecting member, which is used to connect the left and the right frames, is made of excessive hard material. The connecting member can not meet consumers with different face profiles, and even can not touch their faces fitly, resulting in water leakage.

SUMMARY OF THE INVENTION

Accordingly, an object of the present invention is to provide swimming goggles which make users feel comfortable and prevent from leakage.

The swimming goggles comprise an integral left and right frames and nose bridge, lenses received in the left and right frames, pads and a head strap. The integral left and right frames and nose bridge include an outer frame and an inner frame. The outer frame comprises front sections of the left and right frames and the nose bridge. The inner frame comprises rear sections of the left and right frames and the nose bridge. The pads are made of soft material and are assembled on the rear sections of the left and right frames. The head strap is assembled on the outer frame.

The outer frame and the inner frame are made of different material or of the same material with different rigidity.

The hard outer frame bears pulling force from the head strap when being worn, minimizing influence on the lenses. The soft nose bridge has appropriate flexibility. The pads are soft enough to provide comfortable feeling for users, and to match users with different face profiles, preventing from leakage.

DESCRIPTION OF THE PREFERRED EMBODIMENTS

Figure 1:
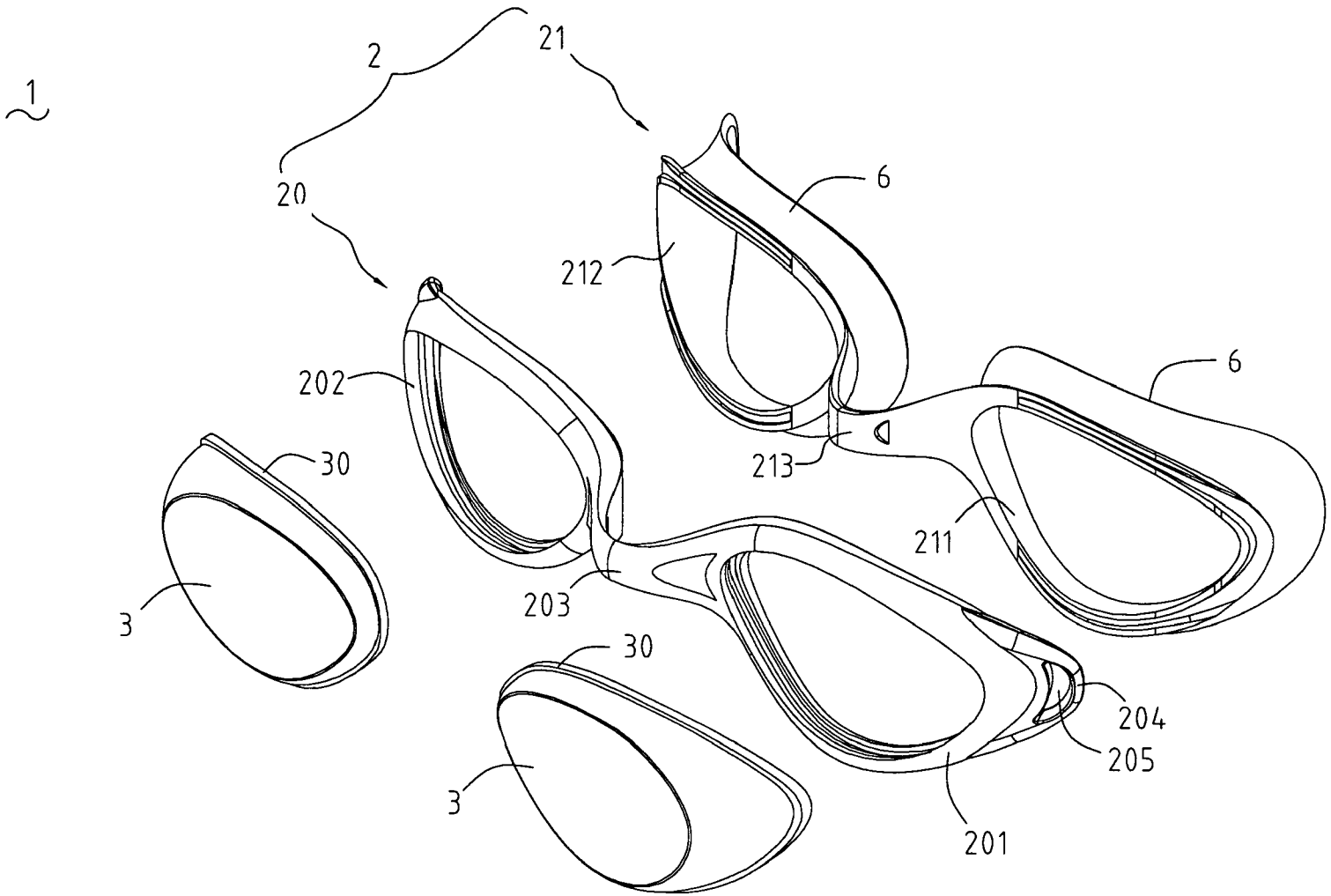
FIG. 1 is an exploded view of swimming goggles according to a first embodiment of the present invention.

Referring to FIG. 1, swimming goggles 1 in accordance with the present invention comprise an integral left and right frames and nose bridge 2, lenses 3, pads 6 and a head strap (not shown). The integral left and right frames and nose bridge 2 comprise an outer frame 20 and an inner frame 21 which may be made of different material or of the same material with different rigidity. In this embodiment, the outer frame 20 and the inner frame 21 are made from Thermoplastic Rubber (TPR) with different plastic characteristics of molding, shaping and gluing. The outer frame 20 and the inner frame 21 match with different colors for achieving colorful look. The outer frame 20 comprises front sections of the left and right frames 201, 202 and a front section of the nose bridge 203. Assembling portions 204 are formed on outward sides of the front sections of the left and right frames 201, 202 and along outer rims of the front sections of the left and right frames 201, 202. Through holes 205 are defined in the assembling portions 204 for threading the head strap therethrough. The inner frame 21 comprises rear sections of the left and right frames 211, 212 and a rear section of the nose bridge 213. The pads 6 are made of the same material as the inner frame 20, and the material of the pads 6 has lower rigidity compared to the inner frame 20. Notably, in practice, the front sections of the left and right frames 201, 202 and the nose bridge 203, and the rear sections of the left and right frames 211, 212 are made of material with a certain rigidity against pulling force when being worn. The pads 6 are made of soft material. The rear section of the nose bridge 213 is made of material softer than the front section of the nose bridge 203 and harder than the pads 6. Alternatively, the front sections of the left and right frames 201, 202 and the front section of the nose bridge 203 are made of material with a certain rigidity against pulling force when being worn. The rear sections of the left and right frames 211, 212 and the rear section of the nose bridge 213 are made of material softer than the front section of the nose bridge 203 and harder than the pads 6.

The lenses 3 are made from Polycarbonate (PC), and have flanges 30 along rims thereof. The flanges 30 are unitarily enveloped by the outer frame 20 and the inner frame 21 when injection shaping.

Figure 2:
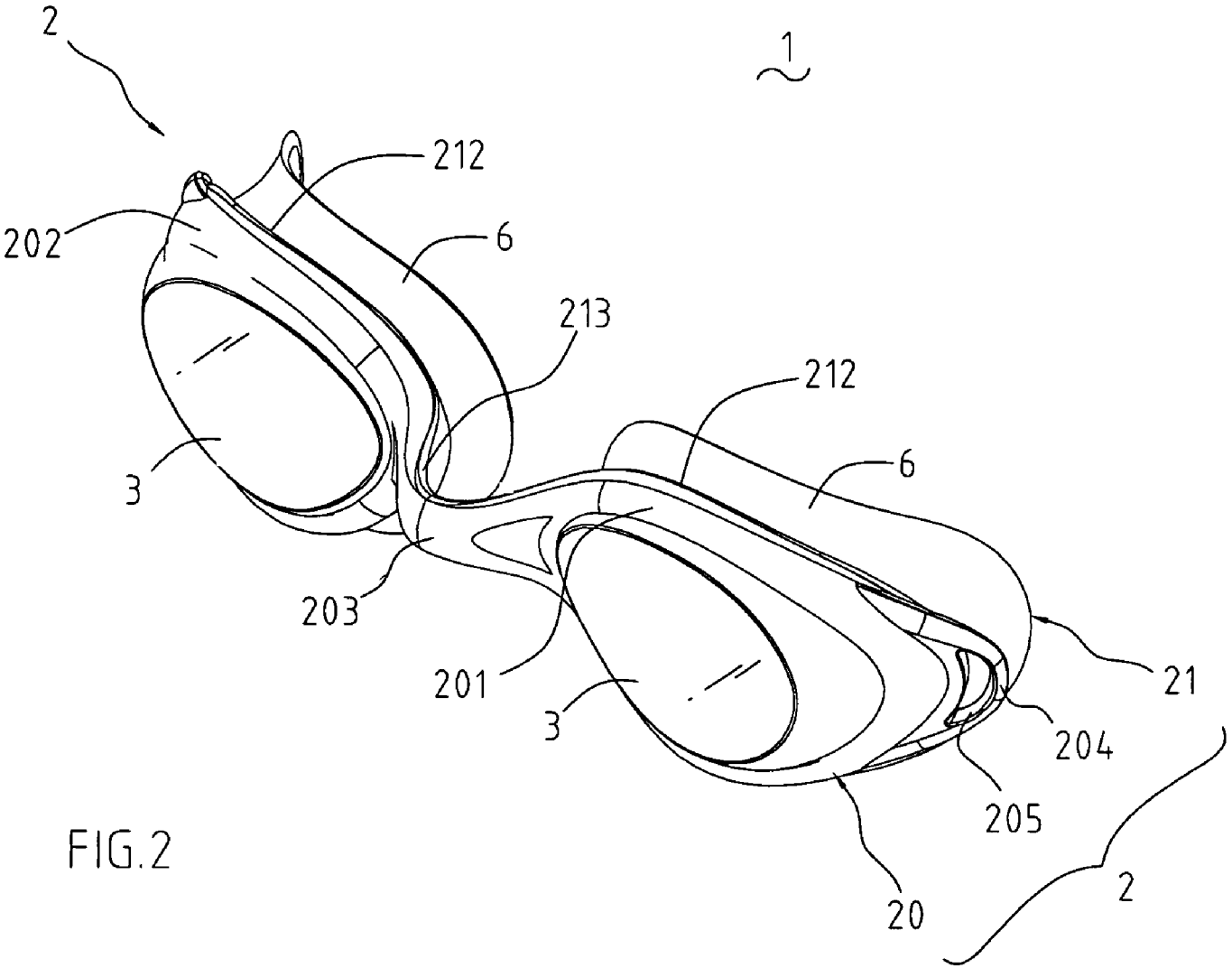
FIG. 2 is an assembled view of the swimming goggles of FIG. 1.
Figure 4:
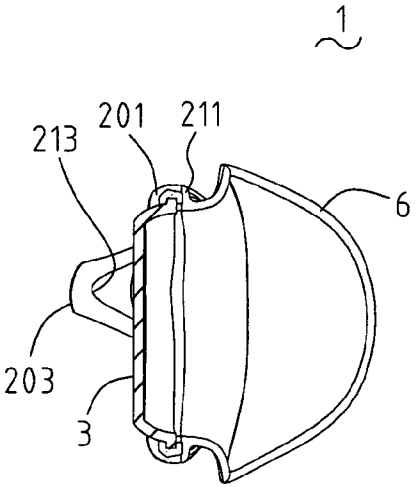
FIG. 4 is a cross-sectional view taken along the line 4-4 in FIG. 3.
Figure 3:
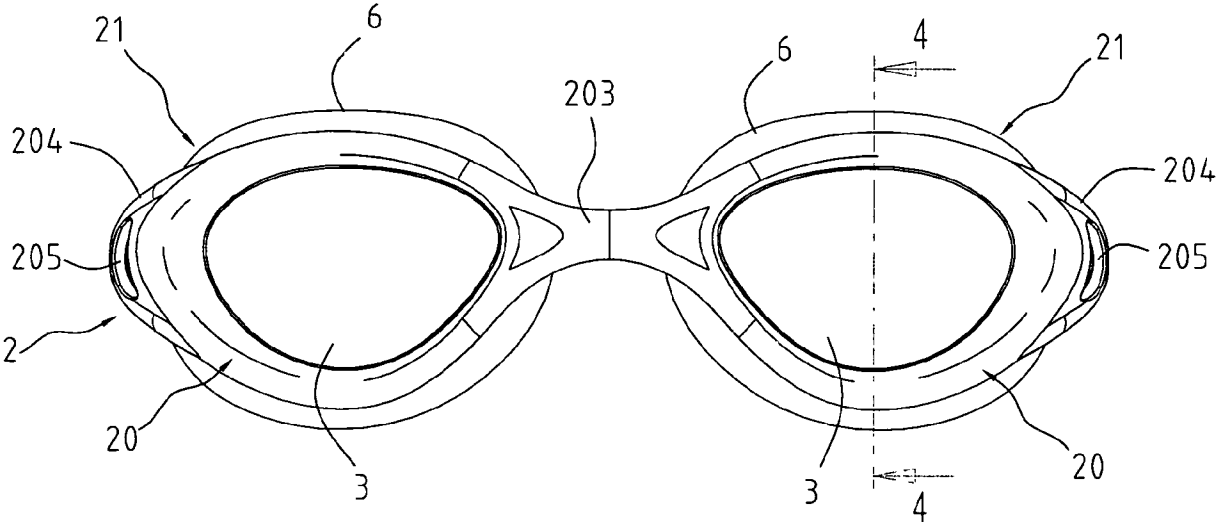
FIG. 3 is a front view of the swimming goggles of FIG. 2.

With reference to FIGS. 2 through 4, when the outer frame 20 and the inner frame 21 are shaped by injection, the flanges 30 of the lenses 3 are enveloped by and are glued with the outer frame 20 and the inner frame 21. The head strap extends through the through holes 205. The front sections of the left and right frames 201, 202 and the front section of the nose bridge 203 are rigid enough to resist from pulling force when being worn, and the assembling portions 204 are made of relatively hard material. Thus the front sections of the left and right frames 201, 202 are not affected when being worn. The rear section of the nose bridge 213 is made of relative soft material such that possesses appropriate flexibility to fit for users with different face profiles and prevents from leakage. The pads 6 are made of soft material thereby providing comfortable feeling for users.

Figure 5:
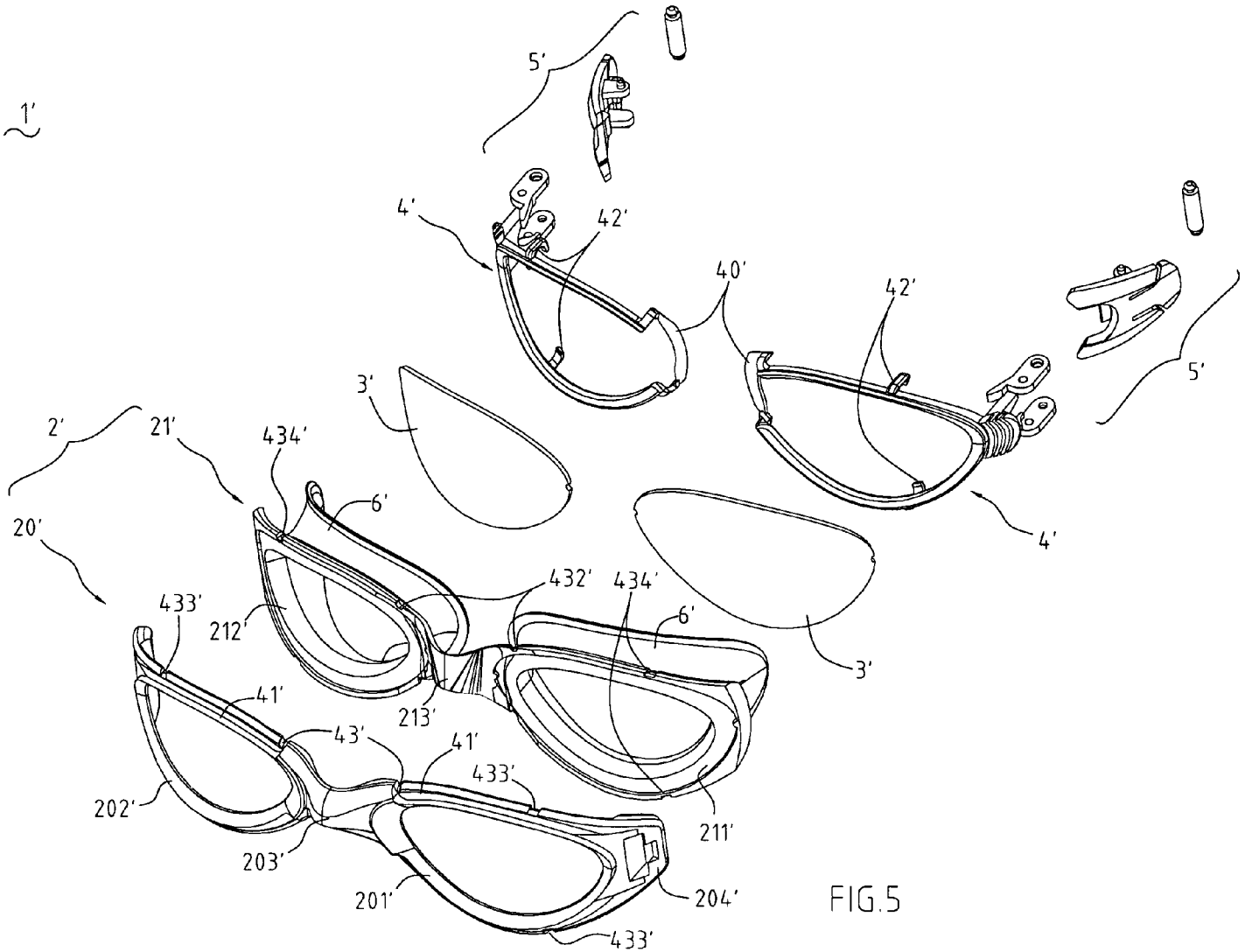
FIG. 5 is an exploded view of swimming goggles according to a second embodiment of the present invention.
Figures 6, 7:
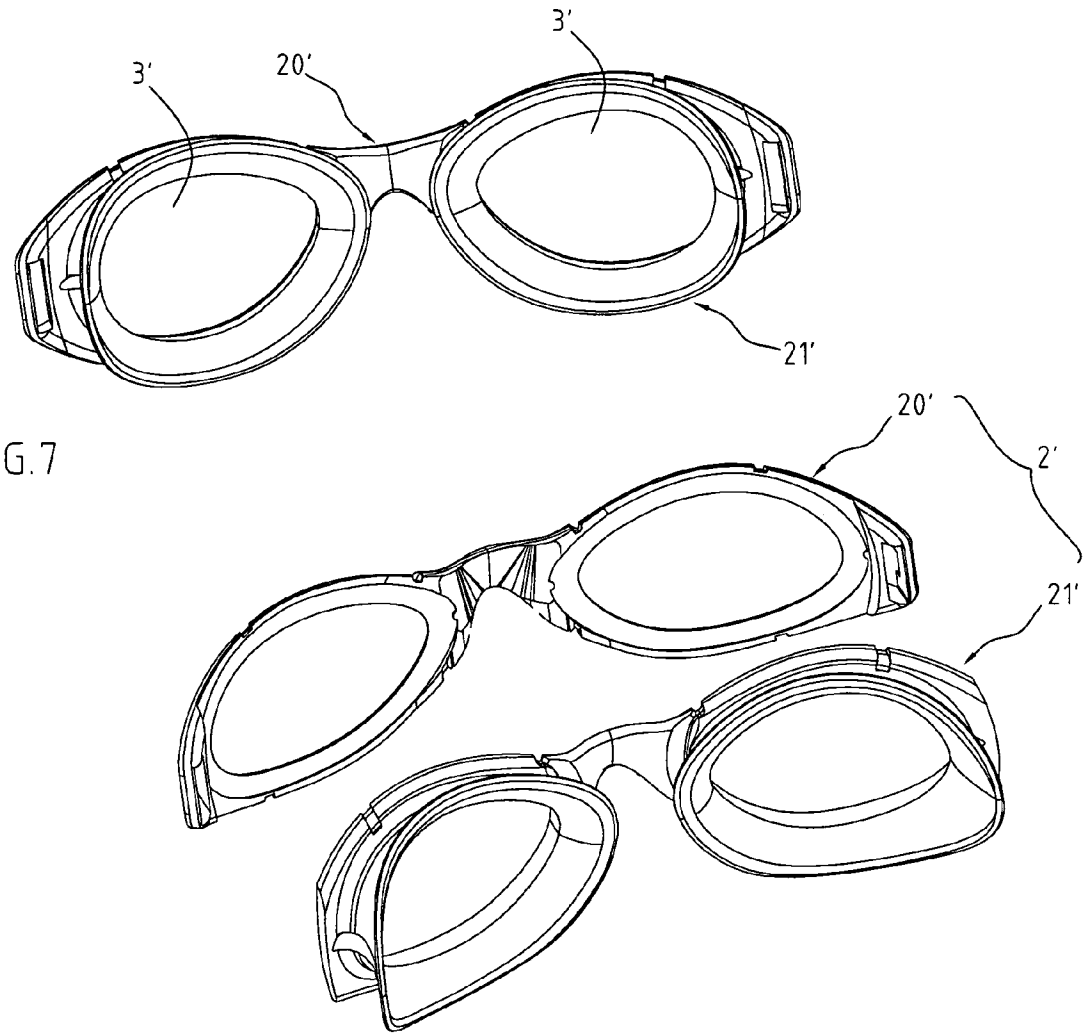
FIGS. 6 and 7 show an inner frame and an outer frame of the swimming goggles of FIG. 5 assembled step by step.

FIG. 5 illustrates a second embodiment of the present invention. Similar to the first embodiment, the swimming goggles 1' of the second embodiment comprise an integral left and right frames and nose bridge 2', lenses 3' and pads 6'. The integral left and right frames and nose bridge 2' comprise an outer frame 20' and an inner frame 21'. The outer frame 20' comprises front sections of the left and right frames 201', 202' and a front section of the nose bridge 203'. Assembling portions 204' are formed on outward sides of the front sections of the left and right frames 201', 202' and along outer rims of the front sections of the left and right frames 201', 202'. The inner frame 21' comprises rear sections of the left and right frames 211', 212' and a rear section of the nose bridge 213'. The pads 6' are integrally formed with the rear sections of the left and right frames 211', 212'. The difference between the second embodiment and the first embodiment focuses on the material. The outer frame 20' and the inner frame 21' are made of the same material Silicon Rubber and are of different colors. The material Silicon Rubber is soft and is difficult to glue to dissimilar material. In the second embodiment, hard clamp frames 4' are provided for clamping the front sections of the left and right frames 201', 202'. The outer frame 20', the inner frame 21' and the pads 6' are injection shaped like the first embodiment. In assembly, as shown in FIG. 6, the outer frame 20' and the inner frame 21' are injection shaped, and then in cooperation with the clamp frames 4', as shown in FIG. 7, retain the lenses 3'. The lenses 3' are made of Cellulose Acetate (AC).

Figure 9:
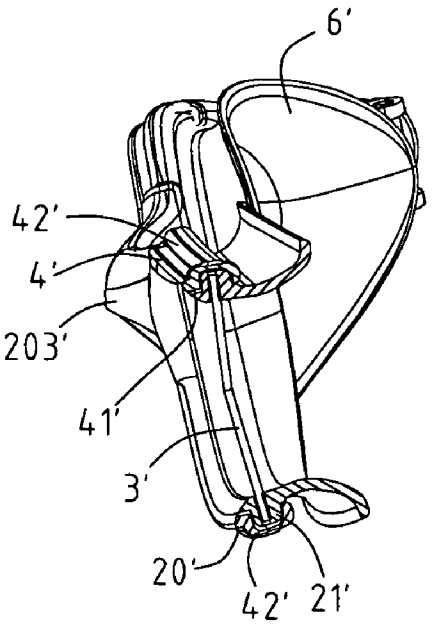
FIG. 9 is a cross-sectional view taken along the line 9-9 in FIG. 8.
Figure 8:
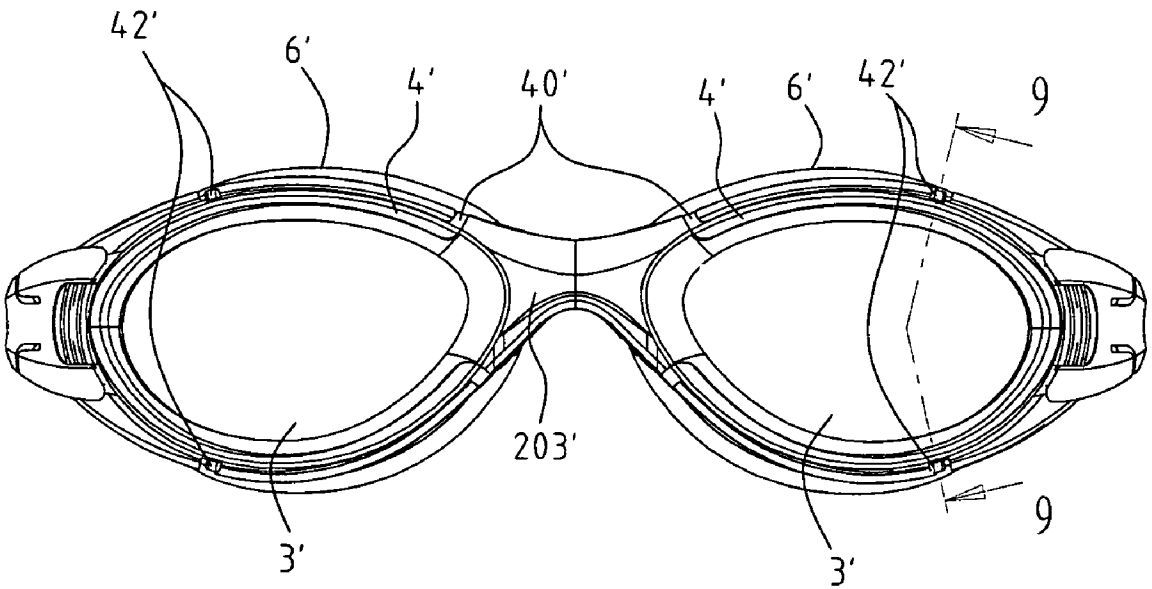
FIG. 8 is a front view of the assembled swimming goggles of FIG. 5.

Further referring to FIGS. 8 and 9, anchors 40' are respectively disposed on joint points of the clamp frames 4' with the front section of the nose bridge 203', the rear section of the nose bridge 213', the front sections of the left and right frames 201', 202', and the rear sections of the left and right frames 211', 212'. The anchors 40' form steps in respect to the clamp frames 4', and lock with inner edges of the front sections and the rear sections of the left frames and the right frames 201', 202', 211', 212'. Embedding grooves 431', 432' are respectively defined in joint portions of the front sections and rear sections of the left frames and the right frames 201', 202', 211', 212' with the front section and rear section of the nose bridge 203', 213' for receiving the anchors 40'. The front sections of the left frames and the right frames 201', 202' form assembling ridges 41' along peripherals thereof adjacent the lenses 3'. The clamp frames 4', together with the anchors 40', lock with the inner edges of the front sections and rear sections of the left frames and the right frames 201', 202', 211', 212'. Thus the lenses 3' are continuously enclosed by the assembling ridges 41' and the clamp frames 4'. Each clamp frame 4' forms at least a pair of locking arms 42'. Locking grooves 433', 434' are respectively defined in the front sections and rear sections of the left frames and the right frames 201', 202', 211', 212' and lock with the locking arms 42' for fixing the lenses 3'. A head strap 5' connects with outward sides of the clamp frames 4'.

The front sections of left and right frames 201', 202' and the front section of the nose bridge 203' are rigid enough to resist from pulling force when being worn, and the assembling portions 204' are made of relatively hard material. Thus the front sections of the left and right frames 201', 202' are not affected when being worn. The rear section of the nose bridge 213' is made of relative soft material such that possesses appropriate flexibility to fit for users with different face profiles and prevents from leakage. The pads 6' are made of soft material for providing comfortable feeling for users.

It is understood that the invention may be embodied in other forms without departing from the spirit thereof. Thus, the present examples and embodiments are to be considered in all respects as illustrative and not restrictive, and the invention is not to be limited to the details given herein.

What is claimed is:

1. Swimming goggles comprising:

an integral left and right frames and nose bridge including an outer frame and an inner frame, the outer frame comprising front sections of the left and right frames and the nose bridge, the inner frame comprising rear sections of the left and right frames and the nose bridge, wherein the outer frame and the inner frame are made of Silicon Rubber with different rigidity and are of different colors;

pads made of soft material same as the inner frame and being assembled on the rear sections of the left and right frames;

lenses received in the left and right frames of the outer frame and the inner frame; and a head strap assembled on the outer frame;

wherein hard clamp frames are provided for clamping the front sections of the left and right frames, and wherein anchors are respectively disposed on joint points of the clamp frames with the front and rear sections of the nose bridge and the front and rear sections of the left and right frames, the anchors forming steps in respect to the clamp frames and locking with inner edges of the front and rear sections of the left and right frames, the front sections of the left and right frames forming assembling ridges along peripherals thereof and adjacent to the lenses, and the assembling ridges and the clamp frames continuously enclosing the lenses.

2. The swimming goggles as claimed in claim 1, wherein assembling portions are formed on outward sides of the front sections of the left and right frames, through holes being defined in the assembling portions for allowing the head strap being threaded therethrough.

3. The swimming goggles as claimed in claim 1, wherein the lenses are made from Polycarbonate (PC), and have flanges along rims thereof, the flanges being unitarily enveloped with the outer frame and the inner frame during injection shaping.

4. The swimming goggles as claimed in claim 1, wherein each clamp frame forms at least a pair of locking arms, and wherein locking grooves are respectively defined in the front sections and the rear sections of the left frames and the right frames for locking with the locking arms.

5. The swimming goggles as claimed in claim 4, wherein embedding grooves are respectively defined in joint portions of the front sections and the rear sections of the left frames and the right frames with the front section and the rear section of the nose bridge for receiving the anchors.

6. The swimming goggles as claimed in claim 1, wherein a head strap connects with outward sides of the clamp frames.

7. The swimming goggles as claimed in claim 1, wherein the lenses are made of Cellulose Acetate (AC).

* * * * *